US005735520A

United States Patent [19]

Matos

[11] Patent Number: 5,735,520

[45] Date of Patent: Apr. 7, 1998

[54] FOLD-THROUGH PICTURE PUZZLE

[75] Inventor: Jose R. Matos, Plano, Tex.

[73] Assignee: Lulirama International, Inc., Dallas, Tex.

[21] Appl. No.: 796,977

[22] Filed: Feb. 7, 1997

[51] Int. Cl.[6] ..... A63F 9/08

[52] U.S. Cl. ..... 273/155

[58] Field of Search ..... 273/153 R, 155, 273/157 R

[56] References Cited

U.S. PATENT DOCUMENTS

| | | | |
|---|---|---|---|
| 239,879 | 4/1881 | Stranders . | |
| 847,545 | 3/1907 | Braine . | |
| 942,536 | 12/1909 | Bartsch | 273/155 |
| 1,547,967 | 7/1925 | Shilhan | 273/155 |
| 2,092,583 | 9/1937 | Michael | 273/155 |
| 2,096,130 | 10/1937 | Phillips | 273/155 |
| 2,250,093 | 7/1941 | Comroe | 273/155 |
| 2,327,875 | 8/1943 | Edborg | 273/155 |
| 2,327,876 | 8/1943 | Edborg | 273/155 |
| 2,655,382 | 10/1953 | Belsky | 273/155 |
| 3,645,534 | 2/1972 | Weisbecker | 273/157 A |
| 3,826,029 | 7/1974 | Lieberman | 273/155 |
| 3,962,816 | 6/1976 | Sarid | 273/155 |
| 4,170,355 | 10/1979 | Finkin | 273/155 |
| 4,366,961 | 1/1983 | Busse | 273/155 |
| 4,429,878 | 2/1984 | Asao | 273/155 |
| 4,588,210 | 5/1986 | Tabatch et al. | 283/63 |
| 5,445,380 | 8/1995 | Polsky | 273/155 |
| 5,564,704 | 10/1996 | Yang | 273/155 |

*Primary Examiner*—Steven B. Wong

*Attorney, Agent, or Firm*—Akin, Gump, Strauss, Hauer & Feld, L.L.P.

[57] ABSTRACT

The present invention is a fold-through picture puzzle comprising a single sheet base, plural superposed attached sheet bases, a single sheet base folded to form a 3-dimensional object, or plural sheet bases attached to form a 3-dimensional object. Each fold-through picture puzzle is continually foldable in a first forward direction and, during folding, forms assembled images from respective cooperating image portions. Each puzzle will also comprise a suitable number of apertures through which it will fold through itself. In some aspects, the invention is a fold-through picture puzzle book or a fold-through 3-dimensional puzzle or object.

19 Claims, 6 Drawing Sheets

FOLD-THROUGH PICTURE PUZZLE

FIELD OF THE INVENTION

The present invention relates generally to puzzles, and more specifically, to fold-through picture puzzles capable of being continually folded in a first direction to generate an assembled image from a series or group of image portions.

BACKGROUND OF THE INVENTION

Folding picture puzzles are well known in the entertainment, amusement and toy industry. There is always a demand for new, more challenging puzzles with enhanced aesthetic appeal to provide users with more entertainment.

Folding picture puzzles generally form an assembled image from a group of image portions distributed on a piece of paper. By folding the paper along a series of predetermined lines, distributed image portions ultimately are assembled or coalesce to form a desired assembled image. By employing a variety of predetermined folding patterns and different image portions, a variety of assembled images can be formed.

U.S. Pat. Nos. 2,327,875 and 2,327,876 to H. Edborg, 2,655,382 to C. Belsky, 4,170,355 to S. Finkin, and 5,445,380 to N. Polsky are all directed to folding picture puzzles of a variety of constructions.

The Edborg patents depict two embodiments of a folding picture puzzle. The '876 patent covers a six-pointed star shaped puzzle having plural fold lines and a single incision extending from the center to the outer periphery of the star. The puzzle comprises a single two-sided sheet of paper having image portions distributed on upper and lower surfaces. By folding the papers in a variety of ways, different assembled images are formed. The '875 patent covers a square shaped puzzle having plural fold lines and four incisions. Each incision extends from the outer periphery of the paper toward the interior of the paper. Although the construction between the two embodiments is different, they operate in essentially the same manner. However, neither of the embodiments shown are considered fold-through puzzles.

The '382 patent to Belsky discloses a folding picture puzzle comprising a single sheet having a variety of fold lines thereon, so that when the paper is folded along those lines, a particular assembled image is formed. The folded paper toy assumes a rectangular form when folded. This puzzle has no incisions and is not considered a fold-through puzzle.

The Finkin patent is directed to an educational folding picture puzzle comprising a single sheet having defined portions, the portions being a central planar portion and a plurality of arm members extending from the edges of the central planar portion. Again, by folding this paper along any of a variety of creases, a variety of assembled images can be formed. This puzzle has no incisions and is not considered a fold-through puzzle.

The '380 patent to Polsky discloses a folding picture puzzle comprising a single two-sided sheet of paper having a patchwork of partial picture images printed on at least one side, the paper being divided into at least 16 equal uniform squares by a combination of eight incisions and plural creases or fold lines. The incisions extend from the outer periphery of the square inward. By folding along the incisions or creases, a variety of complete individual images can be formed. This puzzle is not considered a fold-through picture puzzle.

None of the known folding picture puzzles have incisions forming an aperture, i.e., when an incision is present it extends to and intersects with the outer periphery of the paper puzzle.

Thus, none of the known folding picture puzzles have an aperture necessary to form a fold-through puzzle. As well, there is no teaching or suggestion in the art of the invention as described and claimed herein.

SUMMARY OF THE INVENTION

The present invention provides a fold-through picture puzzle having many novel and entertainment enhancing aspects and features. A first feature is the fold-through aspect of the folding picture puzzle. A second feature is the ability of the puzzle to resemble real and geometric 3-dimensional objects when folded in particular ways. A third feature is the ability of a single fold-through puzzle to provide a range of and a greater number of pictures than known folding picture puzzles. A fourth feature is the ability of the puzzle to make an interactive fold-through book. A fifth feature is the ability of the puzzle to form a fold-through 3-dimensional puzzle which can fold through and, in some embodiments, invert itself.

One aspect of the invention provides a fold-through picture puzzle capable of continually folding in a first forward direction to form assembled images without having to unfold in a second reverse direction. Thus, one embodiment of the invention provides a fold-through picture puzzle comprising a sheet base having a defined length, width and shape comprising: an outer periphery; an edge defining an aperture in said base sheet, the aperture having a defined length, width, area and shape; and a foldable peripheral portion having a defined area completely surrounding said aperture and being operable to fold-through said aperture. The foldable peripheral portion bears cooperating image portions which form an assembled image when the puzzle is folded.

In some embodiments of the invention, the aperture is disposed approximately centrally in the sheet base. In other embodiments, the length and width of the aperture are approximately equal and approximate one-fourth to three-fourths of the length or width of the sheet base. The aperture can be formed from plural connecting, bisecting or intersecting incisions in the sheet base. In yet other embodiments, the area of the peripheral portion can be approximately three-fourths to fifteen times the area of the aperture.

While some embodiments of the invention provide an unsymmetrically shaped sheet base and/or aperture, other embodiments provide a symmetrically shaped sheet base and/or aperture. Still other embodiments of the invention provide a sheet base and/or aperture shaped as a circle, triangle, oval, square, rectangle, pentagon, parallelogram, hexagon, heptagon, octagon, multi-sided polygon having nine to or more sides or a three- to twenty-point star.

Another aspect of the invention provides a fold-through puzzle having plural stacked sheet bases that share a common complementary aperture. This aspect provides a fold-through puzzle which can fold to a large number of configurations forming a corresponding large number of assembled images. This particular aspect is especially useful in making an entirely new form of interactive book. Thus, one embodiment of the invention provides a fold-through puzzle comprising plural superposed attached sheet bases each having a respective defined length, width, area and shape, and each comprising: an edge defining an aperture having a defined length, width, area and shape; and a foldable peripheral portion which bears cooperating image portions, has a defined area completely surrounding the aperture and is operable to fold-through said aperture and form an assembled image; provided that: each of said plural superposed attached sheet bases is attached to another at a respective complementary location, of a respective foldable peripheral portion, adjacent a respective aperture and the apertures of the plural sheet bases form a common complementary aperture.

In another embodiment, the invention provides an interactive fold-through book comprising plural superposed attached sheet bases wherein:

each of said sheet bases has a defined shape, an edge defining an aperture having a defined shape, an outer periphery and a foldable peripheral portion bearing cooperating image portions completely surrounding the aperture for folding through the aperture;

the aperture of each sheet base superposes the aperture of another sheet base;

each of said sheet bases is attached to another at a respective complementary location, of a respective foldable peripheral portion adjacent a respective aperture; and assembled images are formed by folding said foldable peripheral portions bearing cooperating image portions.

The sheet base of the invention will generally bear cooperating image portions or indicia on its surfaces. By folding the sheet base in a variety of ways along specific fold lines, assembled images will form from the cooperating image portions on the surfaces of the sheet base. The assemble images and indicia can be of any type. As well, the surface of the sheet base can bear additional texture enhancing features. The assembled images can include text, graphics, colored patches, buildings, people, animals, food, toys, weapons, machinery, caricatures, fanciful figures, logos, letters, spaceships, and air, land or water borne vehicles, geometric patterns, irregular shapes, and the like, i.e. any image imaginable.

Another aspect of the invention provides a fold-through 3-dimensional puzzle which can fold through and, in some embodiments, invert itself. The 3-dimensional puzzle can be formed from circles, ellipses, ovals, triangles, rectangles, squares, pentagons, parallelograms, hexagons, heptagons, octagons, polygons having nine to twenty sides and combinations thereof. Thus, one embodiment of the invention provides a fold-through 3-dimensional puzzle comprising a single foldable sheet base having a defined 2-dimensional shape, said sheet base comprising:

edges defining plural juxtapositionable apertures;

a foldable peripheral portion bearing cooperating image portions and completely surrounding said plural apertures for folding through said plural apertures when juxtapositioned; and an outer periphery having plural mutually attachable portions;

said sheet base being folded to form a 3-dimensional object having a defined shape.

In another embodiment, the fold-through 3-dimensional puzzle comprises plural attached, foldable sheet bases which together form a 3-dimensional object wherein at least two of said sheet bases have an edge defining an aperture completely surrounded by a respective peripheral portion which is operable to fold-through said apertures and said apertures are juxtapositionable.

Some embodiments of the fold-through 3-dimensional puzzle can employ additional incisions to facilitate folding of the sheet base and folding of the foldable peripheral portions through the apertures.

Another embodiment of the invention provides a fold-through 3-dimensional puzzle comprising plural attached, foldable sheet bases which together form a 3-dimensional object having a defined shape, wherein:

each sheet base has a defined 2-dimensional shape and comprises a respective outer periphery;

at least two of said sheet bases each has an edge defining an aperture completely surrounded by a respective foldable peripheral portion bearing cooperating image portions, said apertures being juxtapositionable one another;

said sheet bases are attached adjacent respective outer peripheries; and assembled images are formed from said cooperating image portions when said sheet bases are folded.

Other features, advantages and embodiments of the invention will be apparent to those skilled in the art by the following description, accompanying examples and appended claims.

BRIEF DESCRIPTION OF THE DRAWINGS

The following drawings are part of the present specification and are included to further demonstrate certain aspects of the invention. The invention may be better understood by reference to one or more of these drawings in combination with the detailed description of the specific embodiments presented herein. In all the drawings herein, a dashed line indicates a fold line, a bold or heavy solid line indicates an incision or aperture, and a thin solid line indicates a boundary.

DETAILED DESCRIPTION OF THE INVENTION

The present invention is different than known folding picture puzzles primarily in that it is a fold-through picture puzzle. Whereas other puzzles cannot be continually folded in a first forward direction, the present fold-through puzzle can due to the presence of an aperture in its sheet base. Generally, the present fold-through picture puzzle comprises a sheet base: bearing cooperating image portions, having an edge defining an aperture, and having a foldable peripheral portion completely surrounding the aperture. By folding the foldable peripheral portion of the sheet base toward and through the aperture, the present puzzle will fold through itself while forming assembled images from the cooperating image portions. The foldable peripheral portion will be continually foldable in a forward or reverse direction.

Additionally, the fold-through puzzle will form 3-dimensional configurations which can be related to the assembled images on the sheet base.

Fold-Through Sheet Base

By "sheet base" is meant an article such as a film, paper, paperboard, thin cardboard and other such articles having a sheet type structure. The sheet base of the invention can be made of any foldable or flexible material. Such materials include, by way of example and without limitation, polymer, paper, plastic or rubber film or laminate, laminated paper, cloth, any combinations thereof, and the like.

The sheet base of the invention will generally have a defined length, width, area and shape. Several exemplary shapes for the sheet base of the invention are shown in FIGS. 1*a*–1*f*. Although the sheet base can be any useful shape, shapes such as a pentagon (FIG. 1*a*), a circle (FIG. 1*b*), a square (FIG. 1*c*), an octagon (FIG. 1*d*), a triangle (FIG. 1*e*), a hexagon (FIG. 1*f*), a rectangle, an ellipse, a heptagon, a rectangle, a parallelogram, a multi-pointed star having three to twenty points, and a multi-sided polygon having nine to twenty sides are particularly contemplated. It should be noted that the sheet base will generally be symmetrically shaped.

Figure 1A:
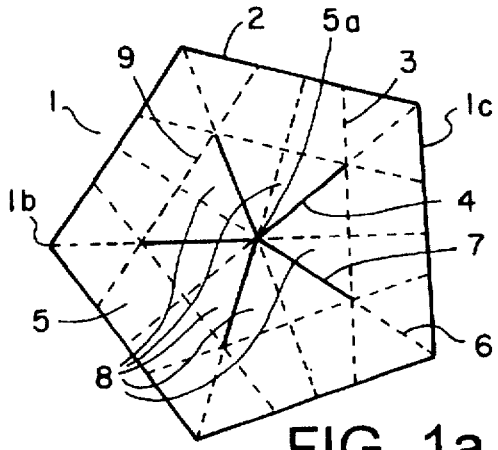
FIGS. 1*a*–1*f*—six exemplary embodiments of the sheet base for the fold-through puzzle of invention.

As depicted in FIG. 1*a*, fold-through sheet base (1) comprises at least the following three elements: an outer periphery (2), an edge (4) defining pentagon-shaped aperture (7) and a foldable peripheral portion (5) bearing cooperating images (not shown) completely surrounding the aperture. By "fold-through" is meant that the foldable peripheral portion of the sheet base will be operable to fold through the aperture.

Sheet base (1) has outer periphery (2) which defines an outer edge or boundary of the base. Outer periphery (2) is separated from aperture (7) by foldable peripheral portion (3). Foldable peripheral portion (3) will have a defined area and will completely surround aperture (7), i.e. edge (4) defining aperture (7) will not intersect with outer periphery (2) of sheet base (1). Foldable peripheral portion (3) will be operable to fold through aperture (7) in sheet base (1) by folding along plural fold lines (3), (6) and (9) and, once folded, passing through aperture (7).

Aperture (7) will have a defined length, width, area and shape. The length and width of aperture (7) can be, but need not be, equivalent and will generally approximate one-fourth to three-fourths of the length and width of sheet base (1). In a preferred embodiment, the length and width of aperture (7) are equivalent. In another preferred embodiment, the length and width of aperture (7) approximate one-third to two-thirds, or more preferably about one-half, the length and width of sheet base (1).

Figure 1B:
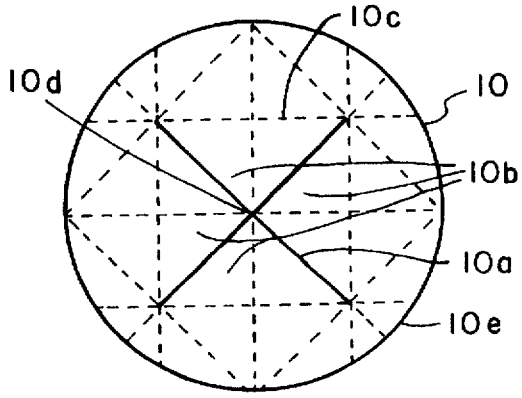
Figure 1C:
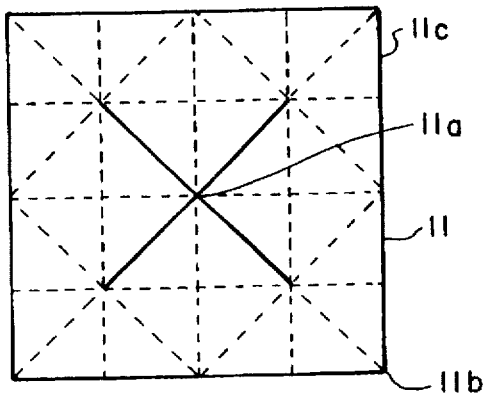
Figure 1D:
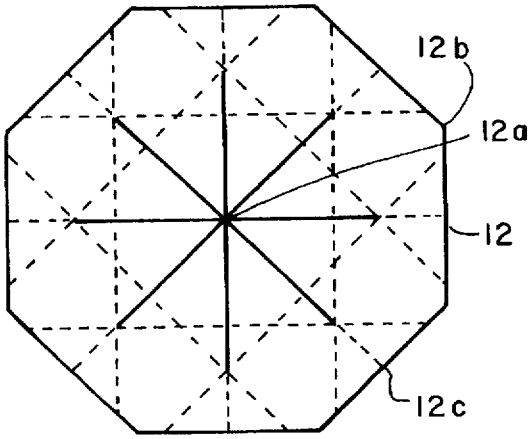
Figure 1E:
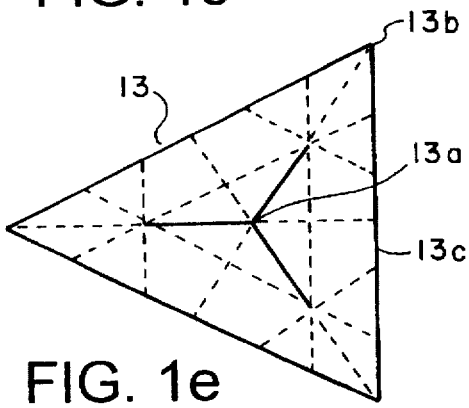
Figure 1F:
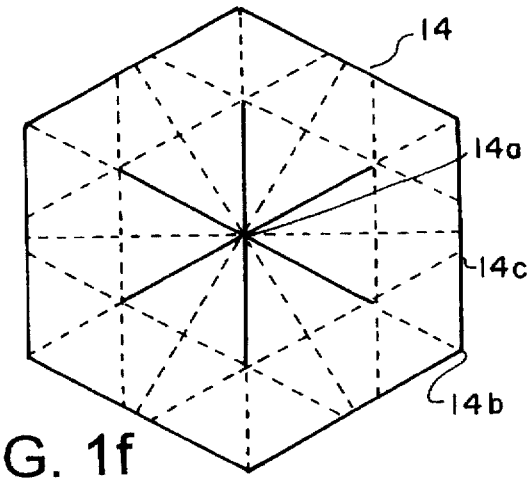

The aperture can be shaped as described above for the sheet base of the invention. The shape of the aperture can be different than the shape of the sheet base. For example, FIG. 1*b* depicts circular sheet base (10) having square shaped aperture (10*a*) formed by folding plural flap sections (10*b*) along plural fold lines (10*c*) out of the plane of sheet base (10). In one preferred embodiment, aperture (10*a*) is symmetrically shaped. In another preferred embodiment (not shown), aperture (10*a*) is shaped similar to respective sheet base (10).

Referring again to FIG. 1*a*, aperture (7) will be formed by plural connecting, intersecting or bisecting incisions once plural flap sections (8) are folded along fold lines (9) above or below a plane along which sheet base (1) lies. As depicted, the plural incisions can, but need not necessarily, intersect or bisect each other at approximately centrally disposed point (5*a*), (10*d*), (11*a*), (12*a*), (13*a*) and (14*a*) in sheet bases (1), (10), (11), (12), (13) and (14), respectively. In various embodiments, two to twenty, preferably two to ten and more preferably two to eight, plural connecting, intersecting or bisecting incisions are employed.

As shown in FIGS. 1*a*–1*f*, the plural incisions are generally evenly spaced and can, but need not necessarily, extend radially from a central point in their respective sheet bases. Thus, the plural incisions can radiate, for example, toward vertices (1*b*), (11*b*), (12*b*), (13*b*) and (14*b*) or sides (1*c*), (11*c*), (12*c*), (13*c*) and (14*c*) of sheet bases (1), (11), (12), (13) and (14), respectively. Although the sheet base of the invention can comprise additional incisions (not shown) which extend from the outer periphery inward, the incisions which form the aperture are not intended to intersect the outer periphery or the additional incisions.

FIGS. 2*a*–2*d* depict other embodiments of the invention wherein an aperture is formed from plural intersecting or connecting incisions that radiate from a central point. Sheet base (20) in FIG. 2*a* has aperture (20*g*) formed by plural connecting incisions (20*c*), (20*d*) and (20*e*) in sheet base (20). The plural incisions also form flap section (20*a*) which folds along folds line (20*h*) to form aperture (20*g*).

Figure 2A:
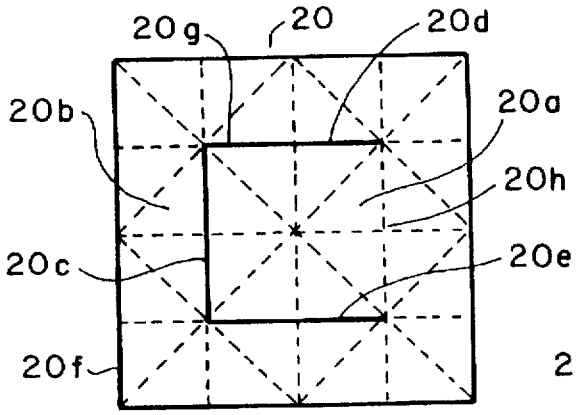
FIGS. 2*a*–2*f*—six exemplary embodiments of the aperture for the square shaped fold-through puzzle of the invention.
Figure 2B:
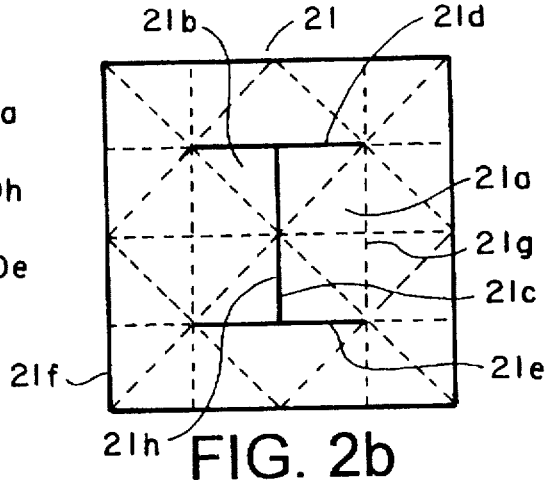
Figure 2C:
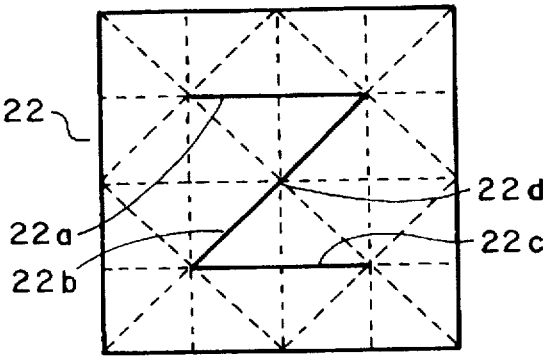
Figure 2D:
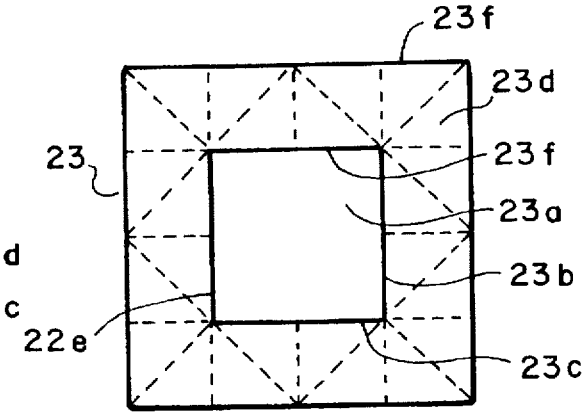
Figure 2E:
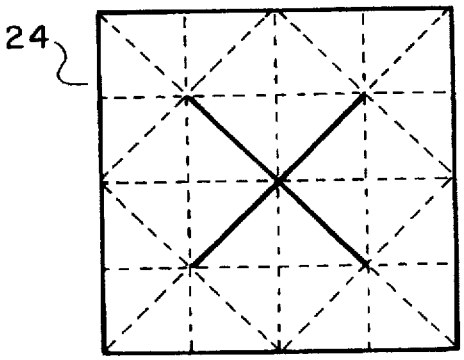
Figure 2F:
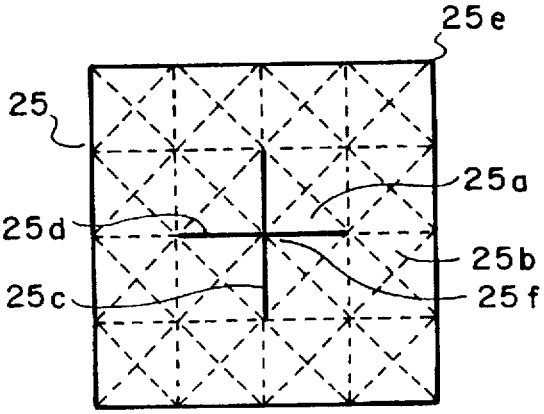

FIG. 2*b* depicts aperture (21*h*) formed from plural intersecting incisions (21*c*), (21*d*) and (21*e*). FIG. 2*c* depicts aperture (22*d*) formed from plural connecting incisions (22*a*), (22*b*) and (22*c*). FIG. 2*d* depicts frame-shaped sheet base (23) having aperture (23*a*) formed from plural connecting and intersecting incisions (23*b*), (23*c*), (23*e*) and (23*f*). It should be noted that sheet base (23) does not have respective flap sections.

As indicated above, the relative defined length, width area and shape of the aperture and peripheral portion of the sheet base of the invention can vary. Generally, the defined area of the peripheral portion will be sufficient to permit bearing a suitable number and size of cooperating image portions. Also, the defined area of the aperture will generally be sufficient to permit fold-through of a corresponding peripheral portion. Accordingly, in a preferred embodiment, the defined area of a peripheral portion approximates three-fourths to fifteen fold, more preferably one to ten fold, and even more preferably about three fold, the area of a corresponding aperture.

The sheet base will bear a patchwork of plural cooperating image portions on its top and bottom surfaces. When the sheet base is folded properly along specific fold lines, the cooperating image portions will be juxtaposed and form one or more assembled images. As indicated above, any imaginable image can be formed. As well, the sheet base can also bear texture, entertainment and/or interaction enhancers such as smooth film, particulates, ridges, bumps, depressions, and the like; odor emitting agents such as perfumes; flavored agents such as food flavoring; and combinations thereof.

Each of the fold-through picture puzzles can be folded in a variety of ways by employing any of a group of folding processes or patterns. One embodiment of the folding processes employed in the present invention is depicted in FIGS. 3*a*–3*e*. Square-shaped fold-through picture puzzle (31) (FIG. 3*a*) comprises: base sheet (31*j*) bearing cooperating image portions (not shown); edge (31*m*) defining aperture (35*k*) which is formed from bisecting incisions (31*n*) and (31*p*); and foldable peripheral portion (31*r*) which completely surrounds aperture (35*k*). Incisions (31*n*) and (31*p*) extend radially from approximately centrally disposed point (31*q*) toward plural vertices (31*s*) of sheet base (31).

Figure 3A:
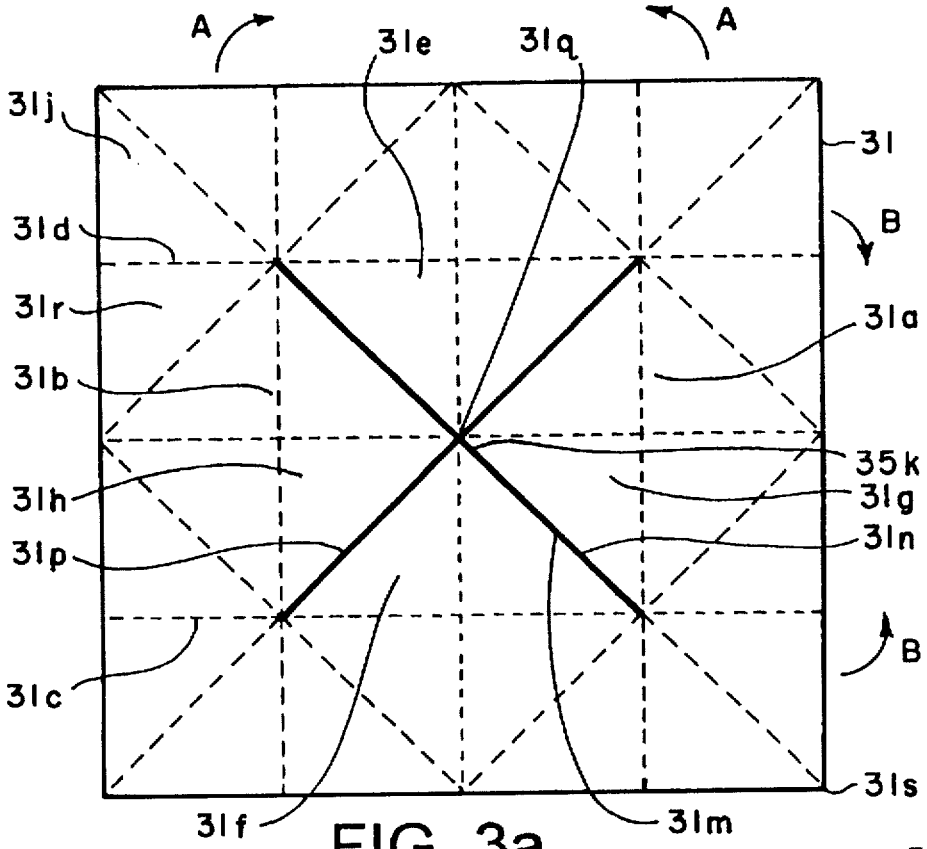
FIGS. 3*a*–3*e*—series depicting some of the folding steps that a fold-through puzzle of the invention can employ in folding a peripheral portion through an aperture.
Figure 3C:
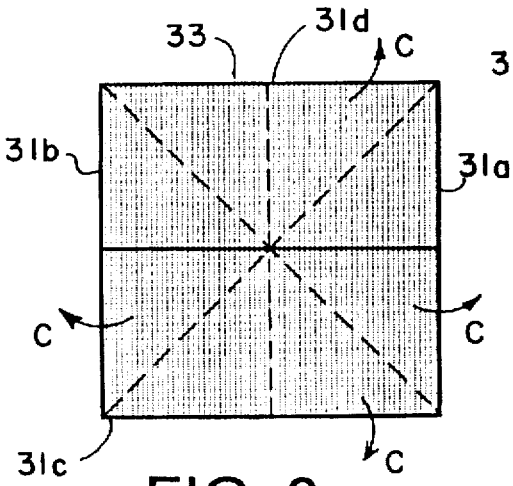
Figure 3B:
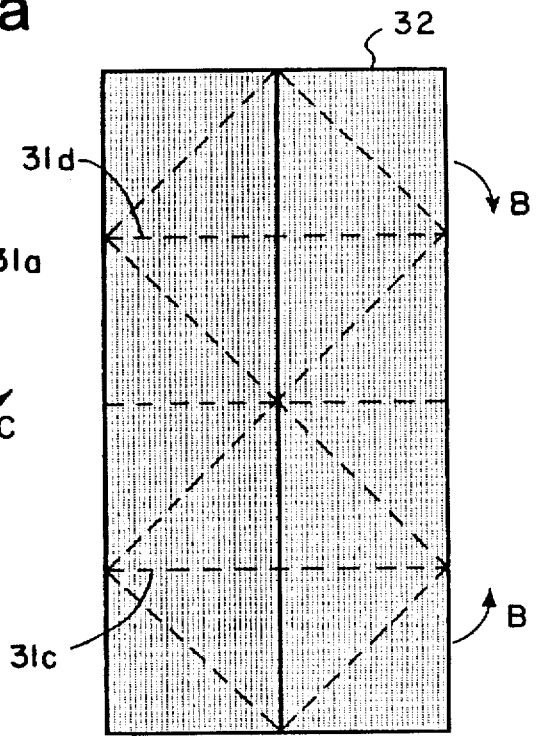
Figure 3D:
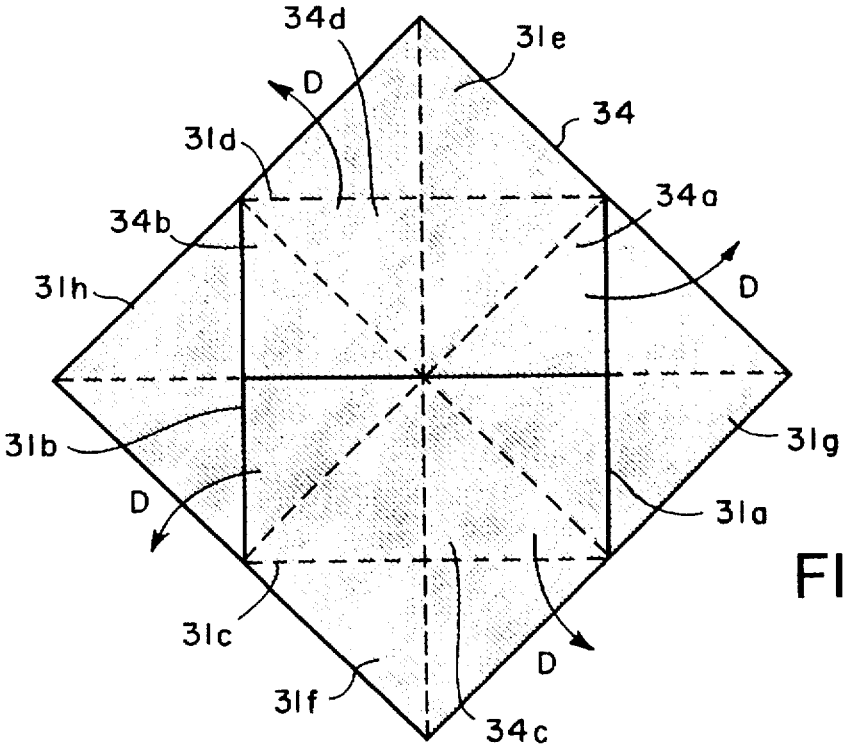
Figure 3E:
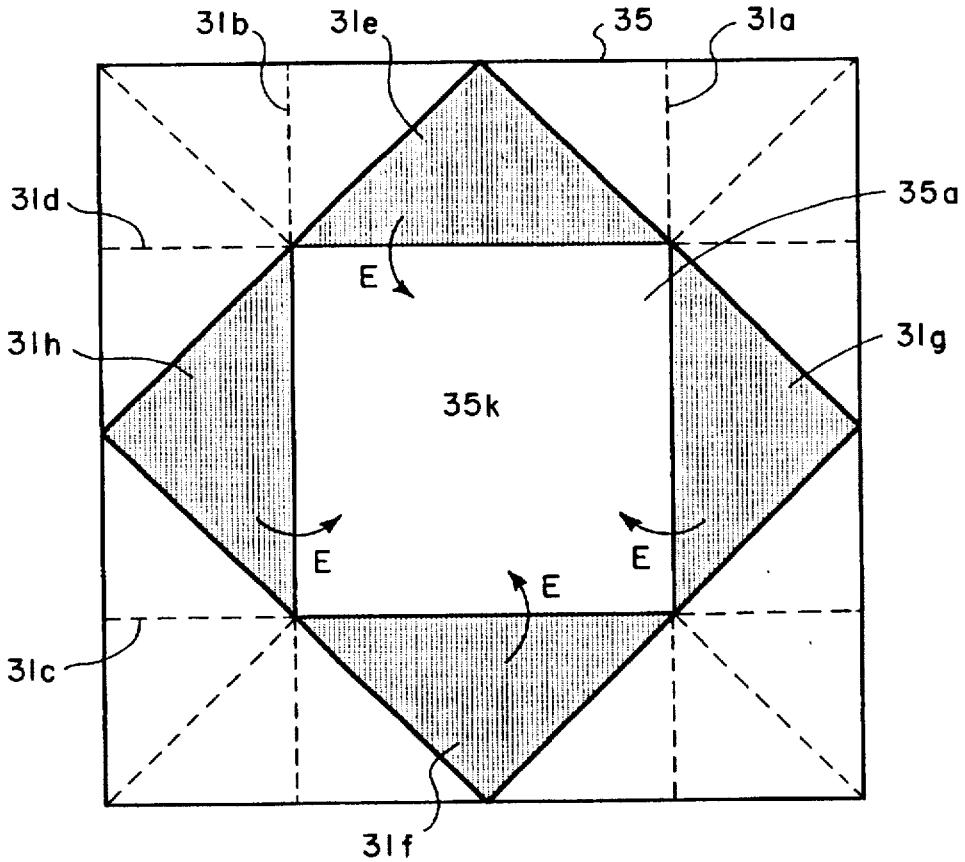

The fold-through process comprises a series of folding steps wherein particular peripheral portion segments of a given sheet base are folded in a desired sequence to form 3-dimensional configurations and assume sequential "positions." FIG. 3*a* depicts the "first position" where sheet base (31) is flat and lies along a plane. By folding peripheral portion (31*j*) along fold lines (31*a*) and (31*b*) above the plane of sheet base (31) in the direction of arrows (A), sheet base (31) assumes the "second" position forming rectangular sheet base (32) as indicated in FIG. 3*b*. The shading indicates the back surface of the sheet base. "Third" position is achieved by folding sheet base (32) along fold lines (31*c*) and (31*d*) above the plane of sheet base (32) in the direction of arrows (B) forming square-shaped sheet base (33) as indicated in FIG. 3*c*. By unfolding flap sections (31*e*), (31*f*), (31*g*) and (31*h*) along fold lines (31*d*), (31*c*), (31*a*) and (31*b*), respectively, below the plane of sheet base (33) in the direction of arrows (C), sheet base (33) assumes the "fourth" position forming diamond-shaped sheet base (34). "Fifth" position is achieved by unfolding rectangular sections (34*a*), (34*b*), (34*c*) and (34*d*) of sheet base (34) along fold lines (31*a*), (31*b*), (31*c*) and (31*d*), respectively, below the plane of sheet base (34) in the direction of arrows (D) forming square-frame-shaped sheet base (35) depicted in FIG. 3*e*. By unfolding flap sections (31*e*), (31*f*), (31*g*) and (31*h*) of sheet base (35) along fold lines (31*d*), (31*c*), (31*a*) and (31*b*), respectively, above the plane of sheet member (35) in the direction of arrows (E) toward aperture (35*k*), sheet base (35) assumes the "first" position forming square-shaped sheet base (31) depicted in FIG. 3*a*.

The fold-through puzzle embodiment of FIG. 3*a* can also employ other folding processes and steps in folding peripheral portion (31*r*) through aperture (35*k*) as exemplified by folding plural vertices (31*s*) into aperture (35*k*) of sheet base (31). Thus, each embodiment of the fold-through puzzle can employ a number of folding processes and the present invention is not limited to a particular folding process.

Fold-Through Book

In another aspect of the present invention, the fold-through picture puzzle can comprise plural sheet bases which form a multi-ply fold-through picture puzzle which can be used as an interactive book. Thus, reading a book can now be an interactive, as opposed to passive, activity by employing the proper combination of a fold-through picture puzzle embodiment and plural cooperating image portions. The fold-through picture puzzle can form 3-dimensional configurations when folded. In some embodiments, the 3-dimensional configurations can be related to corresponding cooperating image portions on the surfaces of the sheet base of the puzzle to tell a story.

Figure 4:
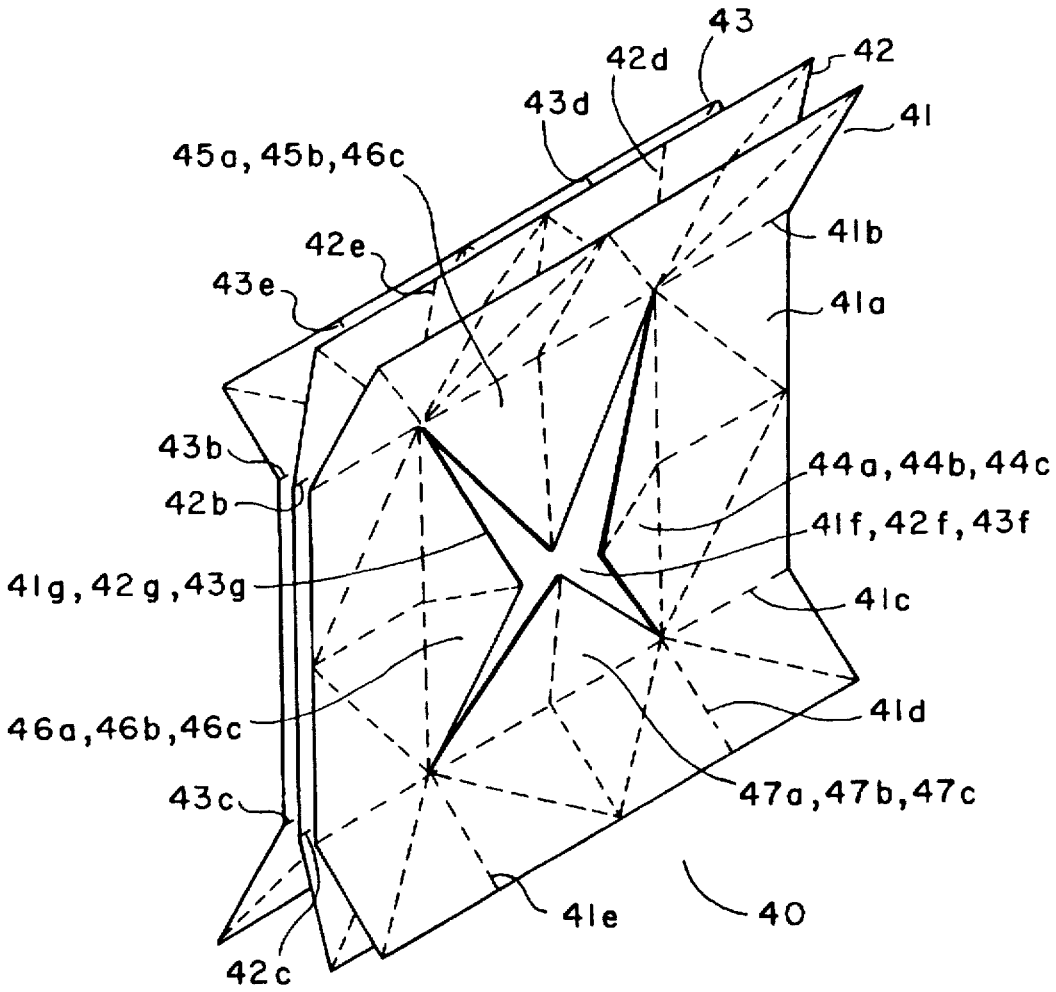
FIG. 4—perspective view of one embodiment of the interactive fold-through book of the invention.

FIG. 4 depicts an exemplary embodiment of an interactive fold-through picture puzzle book. Book (40) comprises plural superposed sheet bases (41), (42) and (43) bearing plural cooperating image portions (not shown), common and complementary apertures (41*f*), (42*f*) and (43*f*), and foldable peripheral portions (41*a*), (42*a*, not shown) and (43*a*, not shown). By folding peripheral portions (41*a*), (42*a*) and (43*a*) simultaneously or sequentially through respective apertures (41*f*), (42*f*) and (43*f*), the book is able to fold through itself while forming a variety of 3-dimensional configurations and assembled images.

Although book (40) comprises three similarly shaped sheet bases, it can comprise two or more, preferably two to twenty, more preferably two to ten and most preferably two to six, similarly or dissimilarly shaped plural superposed sheet bases. The shape of each of said plural sheet bases is independently selected at each occurrence from the shapes indicated above. Plural sheet bases (41), (42) and (43) can each be any shape as contemplated above for the individual sheet bases.

By "common and complementary apertures" is meant that apertures (41*f*), (42*f*) and (43*f*), of respective superposed plural sheet bases (41), (42) and (43), overlap, i.e. are superposed, or are at least partially superposed and are located at complementary locations on their respective base sheets. The shape of apertures (41*f*), (42*f*) and (43*f*) need not be the same; however, each is shaped to permit fold-through of foldable peripheral portions (41*a*), (42*a*) and (43*a*) through itself. Since apertures (41*f*), (42*f*) and (43*f*) can be differently shaped, respective flap portions (44*a–c*), (45*a–c*), (46*a–c*) and (47*a–c*) can also be differently shaped.

Each of plural superposed sheet bases (41), (42) and (43) will be attached to another at respective complementary sections of respective foldable peripheral portions (41*a*), (42*a*) and (43*a*) to maintain them together. Each complementary section will be adjacent a respective common and complementary aperture. Thus, superposed sheet bases (41), (42) and (43) can be attached at complementary flap sections (44*a–c*), (45*a–c*), (46*a–c*) and (47*a–c*), along complementary fold lines (41*b–d*), (42*b–d*) and (43*b–d*), respectively, along complementary edges (41*g*), (42*g*) and (43*g*), respectively, and/or combinations thereof.

Generally, some form of adhesive, staple or tape will be used to attach plural superposed sheet bases (41), (42) and (43), and, virtually any type of adhesive, staple or tape is suitable. In preferred embodiments, an adhesive or double-sided tape is used.

According to the particular combination of shapes of sheet bases and apertures employed in making a fold-through picture puzzle book, a particular fold-through process and series of folding steps will be preferred. Book (40) can employ the fold-through process depicted in FIGS. 3*a–3e* as well as others not described herein.

Fold-through 3-Dimensional Puzzle

The sheet base of the invention, as described above, is generally considered a 2-dimensional object or puzzle, when placed flat along a plane, which forms 3-dimensional configurations when folded through itself. However, as described below, the sheet base of the invention can be provided in the form of a fold-through 3-dimensional puzzle which forms 2-dimensional and additional 3-dimensional configurations when folded through itself. This aspect of the invention provides a fold-through 3-dimensional puzzle which can be folded through itself and, in some embodiments, inverted.

Figure 5:
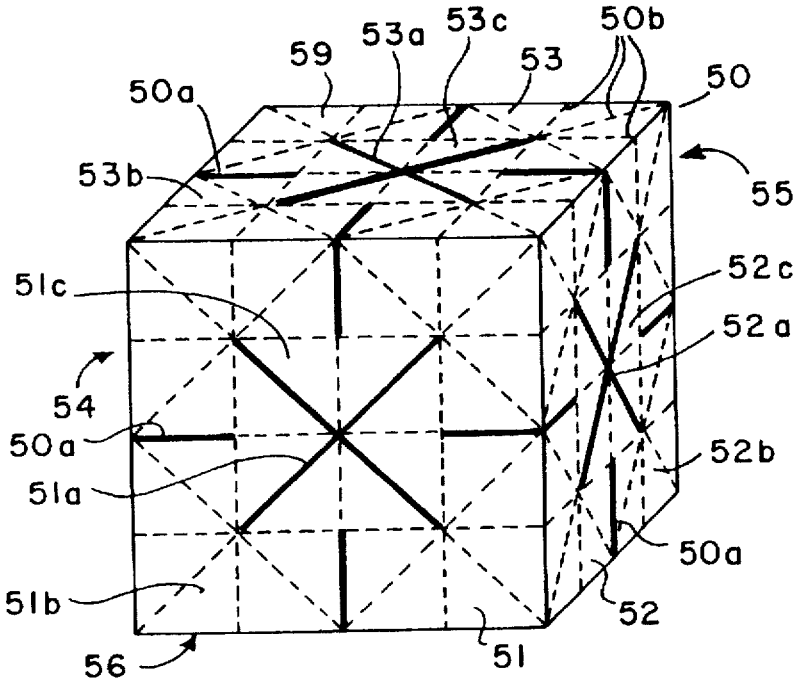
FIG. 5—perspective view of a first embodiment of the fold-through 3-dimensional puzzle of the invention.

FIG. 5 depicts cube-shaped fold-through 3-dimensional puzzle (50) which comprises plural apertures (51*a*), (52*a*), (53*a*), (54*a*, not shown), (55*a*, not shown) and (56*a*, not shown); single, folded sheet base (59) which bears plural cooperating image portions (not shown) on surfaces (51), (52), (53), (54, not shown), (55, not shown) and (56, not shown) and which is folded to form a cube; and plural foldable peripheral portions (51*b*), (52*b*), (53*b*), (54*b*, not shown), (55*b*, not shown) and (56*b*, not shown) which completely surround respective plural apertures (51*a*), (52*a*), (53*a*), (54*a*), (55*a*) and (56*a*).

Puzzle (50) can fold through itself by employing the same folding process and folding steps described in FIGS. 3*a–3e*. Additional plural incisions (50*a*) are optional and can be used to facilitate the fold-through process and provide a puzzle with more folding configurations.

As above, sheet base (59) can be 2-dimensionally shaped as desired. Thus, the 2-dimensional shape of the sheet base can be independently selected at each occurrence from a circle, triangle, oval, square, rectangle, parallelogram, pentagon, hexagon, heptagon, octagon, multi-sided polygon having nine to or more sides or a three- to twenty-point star.

Preferred 2-dimensional shapes for the sheet base of the 3-dimensional puzzle include the square, rectangle, triangle, pentagon, hexagon, ellipse, circle and combinations thereof.

Figure 6:
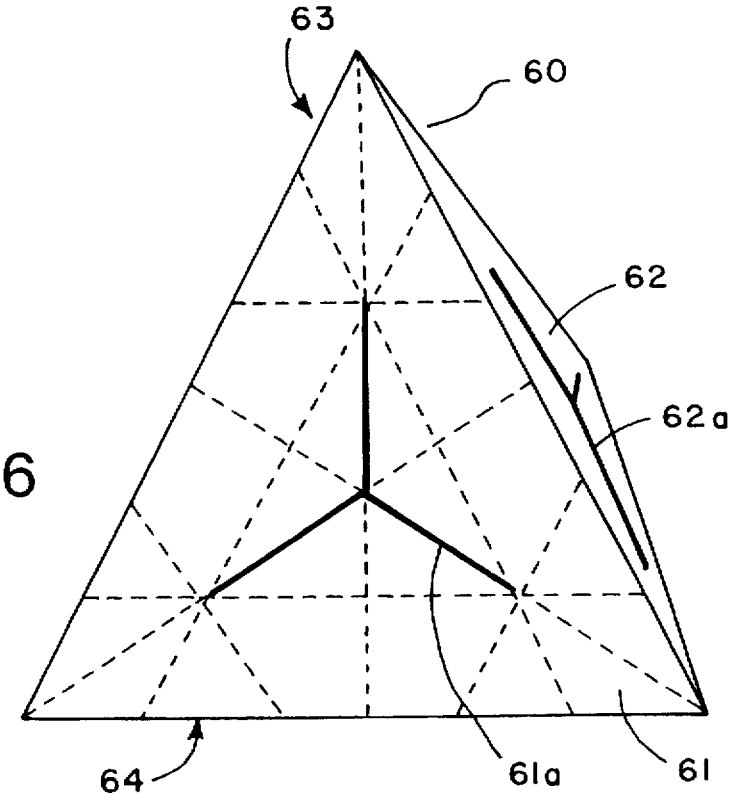
FIG. 6—perspective view of a second embodiment of the fold-through 3-dimensional puzzle of the invention.

The 3-dimensional puzzle can also be shaped as a pyramid, as depicted in FIG. 6 by puzzle (60), by employing plural triangular sheet bases (61), (62), (63) and (64) attached adjacent respective outer peripheries. A single sheet base folded along specific fold lines and attached along or adjacent mutually attachable outer periphery portions can also be used. By "mutually attachable" is meant that the portions can be attached to one another.

The shape of the 3-dimensional puzzle will be dictated by the shape of the sheet base(s) employed in constructing the puzzle. Plural sheet bases having different or similar shapes can be used to construct the puzzle. Preferred shapes for the fold-through 3-dimensional puzzle include a cube, a pyramid, a sphere, and an irregular shape such as of an animal, person, building, vehicle, weapon, food, caricature or other object.

A fold-through 3-dimensional puzzle will have plural, preferably two or more, more preferably two to twenty, even more preferably two to ten, juxtapositionable apertures each being completely surrounded by a respective peripheral portion for folding through said apertures when juxtapositioned.

When a puzzle comprises a single sheet base folded to form a 3-dimensional object, the sheet base will comprise edges defining plural juxtapositionable apertures. When a puzzle comprises plural sheet bases affixed to form a 3-dimensional object, at least two, preferably two to twenty, more preferably two to ten, of the sheet bases will each have an edge defining a juxtapositionable aperture completely surrounded by a respective foldable peripheral portion operable to fold through each aperture. It is only necessary that the apertures be juxtapositionable when corresponding sheet bases are folded during the fold-through process of the invention. The plural sheet bases can be attached adjacent respective outer peripheries.

The above is a detailed description of particular embodiments of the invention. It is recognized that departures from the disclosed embodiments may be made within the scope of the invention and that obvious modifications will occur to a person skilled in the art. Those of skill in the art should, in light of the present disclosure, appreciate that many changes can be made in the specific embodiments which are disclosed herein and still obtain a like or similar result without departing from the spirit and scope of the invention. All of the embodiments disclosed and claimed herein can be made and executed without undue experimentation in light of the present disclosure.

Other features, advantages and embodiments of the invention will be apparent to those skilled in the art by the following description, accompanying examples and appended claims.

Following long-standing patent law convention, the terms "a" and "an" mean "one or more" when used in this specification.

What is claimed is:

1. A fold-through puzzle comprising a sheet base having a defined length, width and symmetrical shape comprising: an outer periphery having opposing perimeter sections;

edges defining an aperture in said sheet base, said aperture having a defined area, length, width and symmetrical shape and said aperture being disposed approximately centrally in said sheet base; and a foldable peripheral portion having opposing sections, a defined area completely surrounding the aperture and being operable to fold completely through the aperture; wherein:

a) said foldable peripheral portion bears cooperating image portions which form an assembled image when said opposing sections of said foldable peripheral portion are folded in the same direction through said aperture along major fold lines which each have a portion coincident with an edge defining said aperture;

b) the area of said foldable peripheral portion is approximately three times the area of the aperture;

c) the shape of said sheet base is one of a square, triangle, rectangle, pentagon, hexagon, heptagon, and octagon;

d) said sheet base and said aperture have the same shape;

e) said aperture is comprised of plural connecting incisions; and f) previously opposing perimeter sections of said outer periphery are brought into close proximity, thereby forming an assembled image, when said opposed sections of said foldable peripheral portion are folded in the same direction toward said aperture.

2. The fold-through puzzle of claim 1, wherein the length and width of the aperture are approximately equal and approximate one-half the length and width, respectively, of said sheet base.

3. The fold-through puzzle of claim 1, wherein said plural incisions comprise two to about twenty incisions.

4. The fold-through puzzle of claim 3, wherein said plural incisions comprise two to about 10 incisions.

5. The fold-through puzzle of claim 3, wherein said plural incisions comprise two to about eight incisions.

6. The fold-through puzzle of claim 1, wherein the shape of said aperture is one of a triangle, square, rectangle, pentagon, hexagon, heptagon, and octagon.

7. The fold-through puzzle of claim 1, wherein said plural connecting incisions bisect each other.

8. A fold-through puzzle comprising plural superposed, attached sheet bases, each having a defined length, width, area and shape and each comprising:

an edge defining an aperture having a defined, length, width, area and shape, wherein the shape of each aperture is the same; and a foldable peripheral portion which bears cooperating image portions, has a defined area completely surrounding the aperture and is operable to completely fold through said aperture and form an assembled image from said cooperating image portions;

wherein:

each of said plural superposed sheet bases is attached to another at a respective complementary section of a respective foldable peripheral portion adjacent a respective aperture; and the apertures of said plural superposed sheet bases form a common complementary aperture.

9. The fold-through puzzle of claim 8, wherein the shape of each of said plural sheet bases is independently selected at each occurrence from a square, triangle, rectangle, pentagon, hexagon, heptagon, and octagon.

10. The fold-through puzzle of claim 8, wherein said plural superposed attached sheet bases comprise two to twenty sheet bases.

11. An interactive fold-through book comprising plural superposed and attached fold-through sheet bases wherein:

each of said sheet bases has a defined shape, an edge defining an aperture having a defined shape, an outer periphery having opposing perimeter sections and a foldable peripheral portion bearing cooperating image portions completely surrounding the aperture and being operable to completely fold through the aperture;

the aperture of each sheet base superposes the aperture of another sheet base to form a common complementary aperture and the shape of each aperture is the same;

each of said sheet bases is attached to another at a respective complementary location, of a respective foldable peripheral portion adjacent a respective aperture; and assembled images are formed by folding said foldable peripheral portions bearing cooperating image portions toward each other into said common complementary aperture thereby bringing said opposing perimeter sections into close proximity.

12. The interactive fold-through book of claim 11, wherein the shape of each of said sheet bases is independently selected at each occurrence from a square, triangle, rectangle, pentagon, hexagon, heptagon, and octagon.

13. The interactive fold-through book of claim 11, wherein said plural superposed attached sheet bases comprise two to twenty sheet bases.

14. A fold-through 3-dimensional puzzle comprising a single foldable sheet base having a defined 2-dimensional shape, said sheet base comprising:

edges defining plural superposable apertures;

a foldable peripheral portion completely surrounding said plural apertures for completely folding through said plural apertures when superposed; and an outer periphery having plural attachable portions; wherein:

a) said sheet base forms a 3-dimensional object having a defined shape prior to folding said foldable peripheral portion through said plural superposable apertures; and b) said defined 2-dimensional shape is selected from a triangle, square, pentagon, hexagon, rectangle, heptagon, octagon, or combinations thereof.

15. The fold-through 3-dimensional puzzle of claim 14, wherein said sheet base forms a 3-dimensional pyramid, cube, sphere, animal, person, building, vehicle, weapon, or caricature.

16. The fold-through 3-dimensional puzzle of claim 14, wherein said plural superposable apertures comprise two to ten superposable apertures.

17. A fold-through 3-dimensional puzzle comprising plural, attached, foldable sheet bases which together form a 3-dimensional object having a defined shape, wherein:

each sheet base has a defined 2-dimensional shape and comprises a respective outer periphery;

at least two of said sheet bases each has an edge defining an aperture completely surrounded by a respective foldable peripheral portion bearing cooperating image portions, said apertures being superposable one another;

said sheet bases are attached adjacent respective outer peripheries; and an assembled image is formed from said cooperating image portions when said sheet bases are folded;

said foldable peripheral portions are operable to completely fold through said superposable apertures; and said plural, attached, foldable sheet bases together form a 3-dimensional object shaped as a pyramid, cube, sphere, animal, person, building, vehicle, caricature or weapon prior to folding said foldable peripheral portions through said superposable apertures.

18. The fold-through 3-dimensional puzzle of claim 17, wherein each of said plural, attached, foldable sheet bases has a 2-dimensional shape that is independently selected at each occurrence from a square, triangle, rectangle, oval, ellipse, circle, pentagon or hexagon.

19. The fold-through 3-dimensional puzzle of claim 17, wherein two to twenty of said plural sheet bases each has an edge defining an aperture completely surrounded by a respective foldable peripheral portion, said apertures being juxtapositionable one another.

* * * * *